US006819204B2

(12) United States Patent
Grunewald

(10) Patent No.: US 6,819,204 B2
(45) Date of Patent: Nov. 16, 2004

(54) BANDPASS FILTER FOR A RADIO-FREQUENCY SIGNAL AND TUNING METHOD THEREFOR

(75) Inventor: Jorg Grunewald, Backnang (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/256,464

(22) Filed: Sep. 27, 2002

(65) Prior Publication Data

US 2003/0080834 A1 May 1, 2003

(30) Foreign Application Priority Data

Sep. 29, 2001 (EP) ..... 01123545

(51) Int. Cl.[7] ..... H01P 1/20
(52) U.S. Cl. ..... 333/204; 333/202; 333/203
(58) Field of Search ..... 333/202, 203, 333/204, 212, 26, 81 A, 219, 25

(56) References Cited

U.S. PATENT DOCUMENTS 5,014,024 A * 5/1991 Shimizu et al. ..... 333/203
5,543,764 A * 8/1996 Turunen et al. ..... 333/202
5,616,538 A * 4/1997 Hey-Shipton et al. ..... 505/210
6,522,217 B1 * 2/2003 Shen ..... 333/99 S

OTHER PUBLICATIONS

Matthaei, George L., et al., *Microwave Filters, Impedance--Matching Networks, and Coupling Structures*, 1964, Artech House Books, Dedham, MA, pp. 421–443 and 583–609.

* cited by examiner

*Primary Examiner*—Brian Young
*Assistant Examiner*—John B Nguyen
(74) *Attorney, Agent, or Firm*—Kirschstein, et al.

(57) ABSTRACT

A bandpass filter for a radio-frequency signal comprises an input section for a signal to be filtered, an output section for the filtered signal and at least one resonator electromagnetically or directly coupled to input and output sections. The shape of the resonator has binary rotation symmetry and/or mirror symmetry with respect to a signal propagation direction and is adapted to be excited into an oscillation having the same type of symmetry by applying the signal to be filtered to the input section.

19 Claims, 7 Drawing Sheets

BANDPASS FILTER FOR A RADIO-FREQUENCY SIGNAL AND TUNING METHOD THEREFOR

BACKGROUND OF THE INVENTION

The present invention relates to a bandpass filter for a radio-frequency signal, in particular in microstrip technique, and a method for tuning the transmission band of such a filter. Filters of this type are known from a number of documents, among which U.S. Pat. No. 5,825,263 and U.S. Pat. No. 5,786,303 are cited here as examples.

Conventional filters of this type, described as prior art in U.S. Pat. No. 5,825,263, are formed of a plurality of conductor segments having a length of $\lambda/4$ or $\lambda/2$ structured on a substrate in a staggered configuration, wherein adjacent segments overlap with each other over a length of $\lambda/4$, $\lambda$ being the wavelength corresponding to a center frequency of the passband of the filter.

FIG. 1 shows such a filter having an input segment 1 and an output segment 3 of length $\lambda/4$ connected to signal lines, and resonator segments 2 of length $\lambda/2$ in between.

The operation principle of this filter relies upon the fact that the resonator segments 2 are consecutively excited to oscillate in their fundamental mode by a radio-frequency signal applied to input segment 1 and having a wavelength $\lambda$ which is two times the length of resonator segments 2. These oscillations, in turn, induce the filtered signal in output segment 3.

The electric currents flowing in the segments induce electromagnetic fields around the segments. While the fields in the substrate plane are necessary in order to excite adjacent segments, the energy contained in fields outside the substrate plane is lost. This causes strong losses of the filter, unless a screening is provided which reflects fields radiated off the substrate plane back to the segments.

However, this screening is no completely satisfying solution to the loss problem. The distance between segments and screening cannot be made zero. In consequence, a phase shift between the currents flowing in the segments and the fields reflected back to the segments by the screening is unavoidable. This leads to a displacement of the transmission frequency of the filter that depends on the distance between the segments and the screening and on the dielectric constant of the material in between. Therefore, it is difficult to produce radio-frequency filters of the type shown in FIG. 1 having a precisely predefined, desired transmission frequency. If a filter having a precisely specified transmission frequency is needed, the only practical possibility is to select, from a large number of finished filters having different center frequencies due to manufacturing scatter, those that have exactly the desired value.

In order to solve the problem of excessive radiation off the substrate plane, U.S. Pat. No. 5,825,263 suggests a filter arrangement which is essentially formed of two pairs of filters, each of which is formed of staggered resonator segments similar to those of FIG. 1, wherein one filter is a mirror-image image of the other. The two inputs of this filter pair are supplied with a balanced input signal, so that in corresponding segments of the filters, currents are flowing in opposite directions at all times. The fields radiated by these currents cancel out on the plane of symmetry between two filters and thus reduce the radiation perpendicular to the substrate plane.

In order to operate such a filter arrangement with an unbalanced signal, it is necessary to provide a balun upstream and downstream of the individual filters for transforming the asymmetric signal into a symmetric, balanced signal and the filtered, balanced signal back into an asymmetric signal, respectively. This prior art filter arrangement is therefore expensive in manufacturing and requires a large substrate surface.

SUMMARY OF THE INVENTION

The object of the present invention is to provide a filter for radio-frequency signals having small radiation loss and, at the same time, a simple, space-saving structure.

The object is solved by a bandpass filter having the features described herein.

By the resonator having a binary (rotation or mirror-image) symmetry and being excitable by the signal to be filtered into a resonance having the same symmetry, it is achieved that a current excited in the resonator spreads out symmetrically in the resonator from a fixed point of the symmetry operation. Accordingly, at all times currents having the same amplitude and opposite polarities exist within the resonator at opposite sides and in equal distances from the center of symmetry—the plane of symmetry, if the binary symmetry operation is a mirror-image reflection, or the axis of symmetry, if the symmetry operation is a 180°-rotation-, the radiation fields of which cancel out on the plane of symmetry or axis. This effect is achieved without before having to convert an asymmetric signal into a balanced signal using a balun.

According to a first preferred embodiment, the bandpass filter comprises at least two resonators, of which one is directly coupled to the input section and the other is directly coupled to the output section. Between said two resonators, further resonators can be provided. Preferably, all these resonators are symmetric with respect to the same mirror plane.

According to a second preferred embodiment, the input section and the output section each comprise a sending electrode for exciting a resonator and an input conductor connected with the sending electrode and/or a receiving electrode to be excited by the resonance of the resonator and an output conductor connected to the receiving electrode, respectively.

Electrodes and resonators are preferably not directly coupled, so that only a capacitive or magnetic coupling is possible between the two.

Said two embodiments can be combined by the electrodes simultaneously being resonators.

Input and/or output conductors preferably extend at right angles with respect to the input and output electrode, respectively. By this arrangement of the input and output conductors, an influence of the fields generated by the conductor on the current distribution in the corresponding electrode is prevented.

Preferably, all resonators have the same extension transversally to the plane of symmetry. This extension corresponds to the entire wavelength $\lambda$ of the resonance frequency of the resonators.

This feature, and more specifically a perfect congruence of the resonators facilitates tuning the bandpass filter of the present invention to a desired resonance frequency, as will become more evident later on.

Preferably, the resonators are elongated transversally with respect to the plane of symmetry. Such a shape enables a very low loss coupling. Considering available space, one might also consider an angled or curved form of the electrodes and the resonators, however, in case of mirror-image symmetry it must then be accepted that the radiated fields no longer cancel out completely in the plane of symmetry.

In an embodiment of the bandpass filter which is particularly simple to manufacture and has low loss, each resonator has a constant cross section area perpendicular to the plane of symmetry.

Alternatively, each resonator may have a constriction in a section between the plane of symmetry and each of its longitudinal ends. This feature has the advantage that the extension of the resonator perpendicular to the plane of symmetry at constant resonance frequency is shortened with respect to the alternative considered above, so that the required area for the bandpass filter can be reduced.

Due to the low radiation, the bandpass filter of the present invention is also operable without a screening enclosing the resonator, and/or its transmission behaviour depends little on such a screening and on the dielectric constant of a material provided between the filter and the screening. Thus it becomes possible to tune such a filter after structuring to a predefined, desired transmission frequency band by removing material from the resonator while maintaining its symmetry. A practical way of carrying out such a removal is laser ablation.

BRIEF DESCRIPTION OF THE DRAWINGS

Further features and advantages of the invention become apparent from the description of embodiments given with respect to the appended figures.

DETAILED DESCRIPTION OF THE PREFERRED EMBODIMENTS

Figure 2:
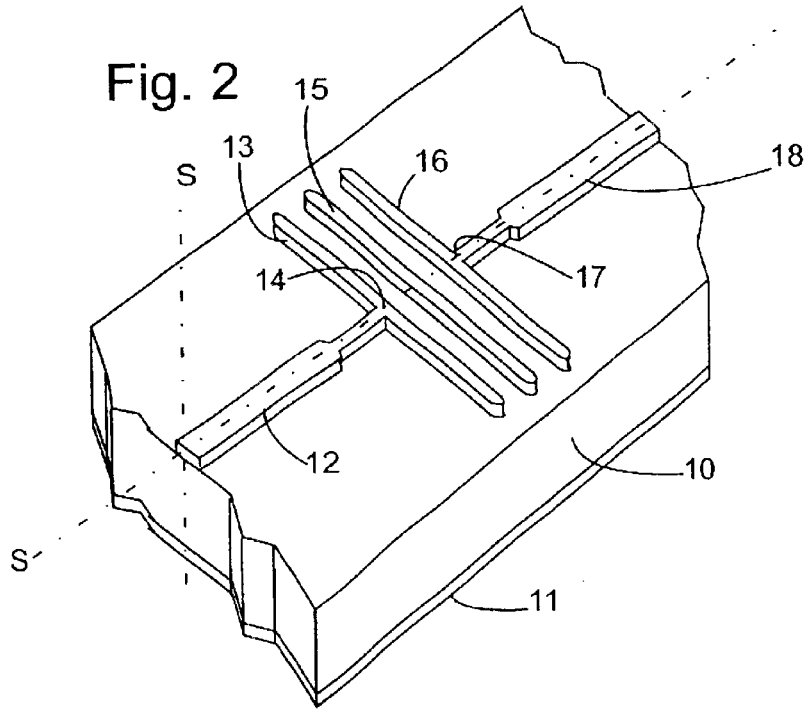
FIG. 2 is a perspective view of a bandpass filter according to a first embodiment of the invention.

FIG. 2 is a perspective view of a filter according to the present invention. On a ceramic substrate 10 made of alumina ($Al_2O_3$) having a thickness of 254 $\mu$m, conducting portions made of gold are formed in microstrip technique. The thickness of the gold layer is 3 $\mu$m. At the bottom of the ceramic substrate 10, a continuous metalization 11 is deposited.

The structured conducting layer at the upper side of substrate 10 comprises an input conductor 12 for the radio-frequency signal to be filtered, meeting at right angles a straight elongated sending electrode 13. The connection point 14 of the input conductor 12 and the sending electrode 13 is exactly in the middle of the latter, on a mirror-image plane of symmetry of the sending electrode 13 indicated by dashed lines S in the Figure.

From connection point 14, the radio-frequency signal input into sending electrode 13 propagates symmetrically in both directions in the longitudinal direction of the sending electrode 13. The electromagnetic fields induced by the currents of same amplitude and opposite polarity flowing at both sides of the plane of symmetry cancel out on the plane of symmetry and have a low level in the vicinity of the plane of symmetry, so that in comparison to the filter of FIG. 1, a substantially reduced radiation perpendicular to the sending electrode results.

By the input radio-frequency signal the sending electrode 13 is excited with a frequency, the wavelength of which corresponds to the longitudinal extension of the electrode 13. The electrode 13 also has a resonance at half of this frequency, however, the currents of this resonance change polarity when reflected at the plane of symmetry. It thus has lesser symmetry, and the fields induced by it do not compensate each other on the plane of symmetry. In the framework of the present invention, this resonance is not desired, and by symmetrically feeding the signal to the sending electrode 13, it is not excited.

A conductor element operating as a resonator like sending electrode 13 and referred to as unconnected resonator 15, also having a straight elongated shape, is arranged in parallel to sending electrode 13 on the ceramic substrate 10. The resonator 15 is not directly coupled to sending electrode 13, has the same shape and has mirror-image symmetry with respect to the same plane of symmetry S. It is adapted to be capacitively and magnetically excited to the same electrical oscillation as the sending electrode 13 by the fields radiated by sending electrode 13 in the plane of substrate 10. Just like the sending electrode 13, the unconnected resonator 15 can resonate at a wavelength equal to twice its length, but, due to the symmetric current distribution in sending electrode 13, such a resonance is not excited.

At the side of the unconnected resonator 15 remote from the sending electrode 13, a receiving electrode 16 is located. It is connected to an output conductor 18 at a central connection point 17. The shapes of receiving electrode 16 and output conductor 18 are a mirror-image image of those of sending electrode 13 and input conductor 12. Currents capacitively and magnetically excited by the currents flowing in unconnected resonator 15 form the output signal of the filter.

Figure 3:
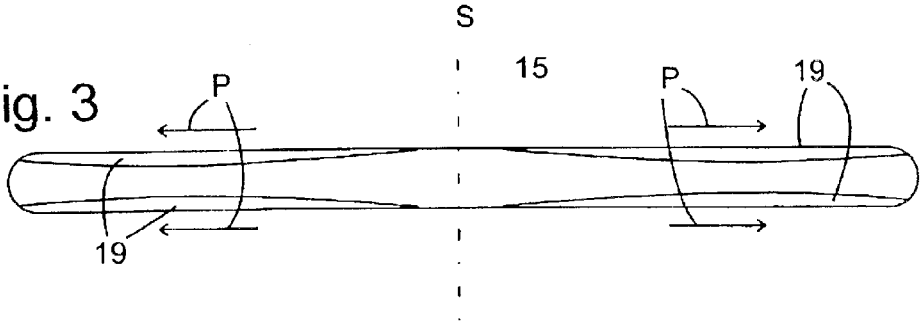
FIG. 3 schematically illustrates the current distribution induced in the resonator of the filter of FIG. 2.

FIG. 3 schematically shows the current distribution induced in resonator 15. At the outer ends of the resonator and on the plane of symmetry S, the current intensity vanishes; zones 19 of maximum intensity are located at the longitudinal sides of the resonator facing electrodes 13 and 16, respectively, at a middle position between its outer ends and the plane of symmetry S. The currents on opposite sides of the plane of symmetry S are oriented in opposite directions at all times, as indicated by arrows P.

Figure 4A:
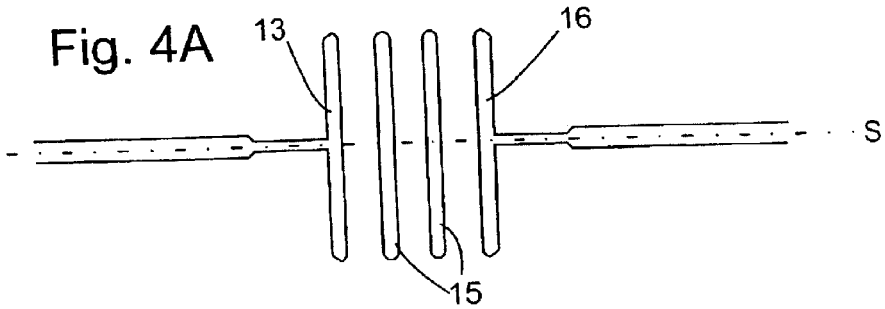
FIGS. 4A, 4B, 5 and 6 are top views of a filter according to second to fifth embodiments of the invention.

FIG. 4A is top view of a second embodiment of the filter of the present invention, in which the substrate is not shown. Two resonators 15 are arranged one after the other between sending and receiving electrodes 13 and 16, respectively. This filter has a narrower bandwidth than that of FIG. 2, in other respects the principle of operation is the same. The number of resonators can also be chosen greater than two.

Figure 4B:
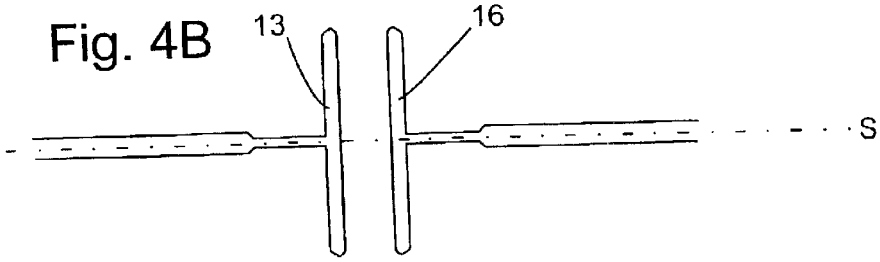

The number of unconnected resonators can also be 0, in this case shown in FIG. 4B, the effect of the filter relies on the resonances of sending and receiving electrodes 13, 16 alone.

Figure 5:
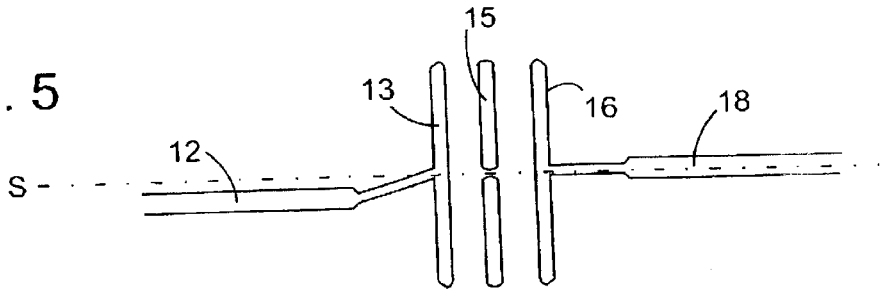

The filter shown in FIG. 5 is distinguished from that of FIG. 2 in that the input conductor 12 does not meet the sending electrode 13 at right angles. An arrangement of input or output conductor of this type or another asymmetric type can become necessary due to lack of space. In such a case, in the filter of FIG. 2 it would not be excluded that due to a small disturbance of symmetry of the current distribution in the sending electrode 13, the resonator 15 is excited to resonate at a wavelength equal to twice the resonator length, resulting in a certain transmission of the filter in a frequency range at half the desired transmission frequency. In order to prevent such a resonance of resonator 15, in the embodiment of FIG. 5 the resonator is interrupted at the plane of symmetry S. In the desired transmission band, the transmission behaviour of the filter is not influenced by this, since, as shown in FIG. 3, under symmetric excitation of the resonator, there is no flow of current across the plane of symmetry.

Figure 6:
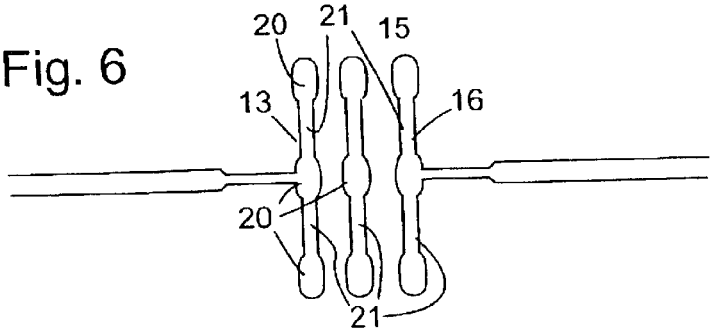

In contrast to the embodiments described up to now, in which the cross section areas of electrodes 13, 16 and of resonator 15 are constant in their longitudinal direction, FIG. 6 shows an embodiment in which the width of electrodes 13, 16 and of resonator 15 varies in their longitudinal direction. To be specific, the electrodes 13, 16 and the resonator 15 each have widened portions 20 at the plane of symmetry and at their ends, and constricted portions 21 in between. By constricting the electrodes and the resonators in a region of high current intensity, for a constant resonance frequency the wavelength of the oscillation excited in the resonator can be reduced, whereby the area required for the filter is reduced.

Figure 7:
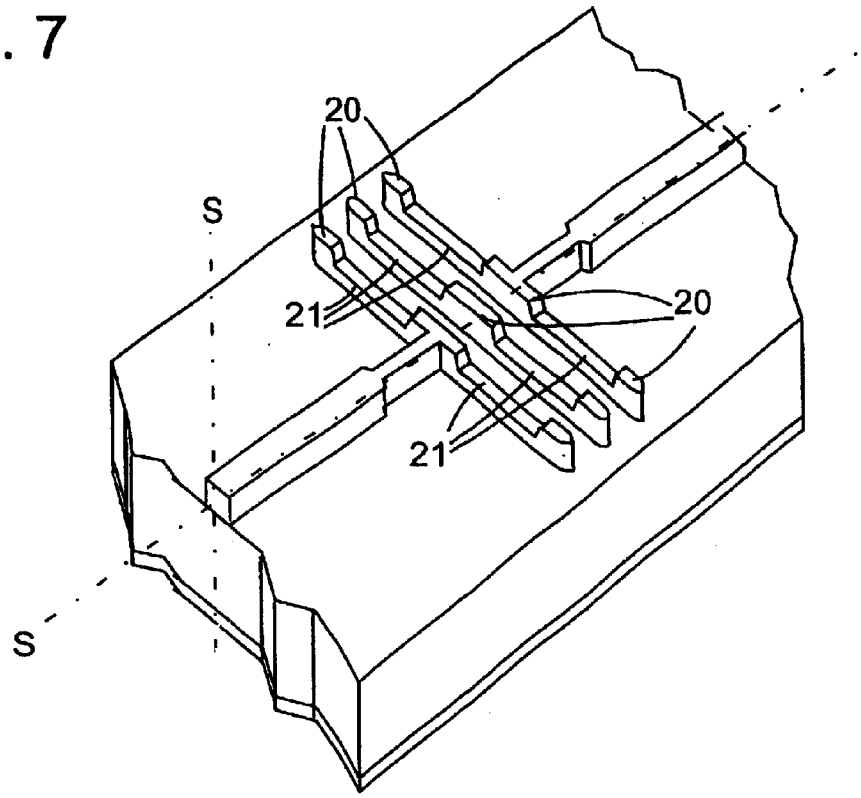
FIG. 7 is a modification of the fifth embodiment in a perspective view.

The same result can be achieved with the modified embodiment of FIG. 7, in which portions 21 of reduced cross section are formed by reducing the thickness of the conductor segments of electrodes 13, 16 and of resonator 15. These portions can, e.g., be formed starting from conductor segments having a constant thickness by etching or laser ablating portions 21 for a short time.

Figure 8A:
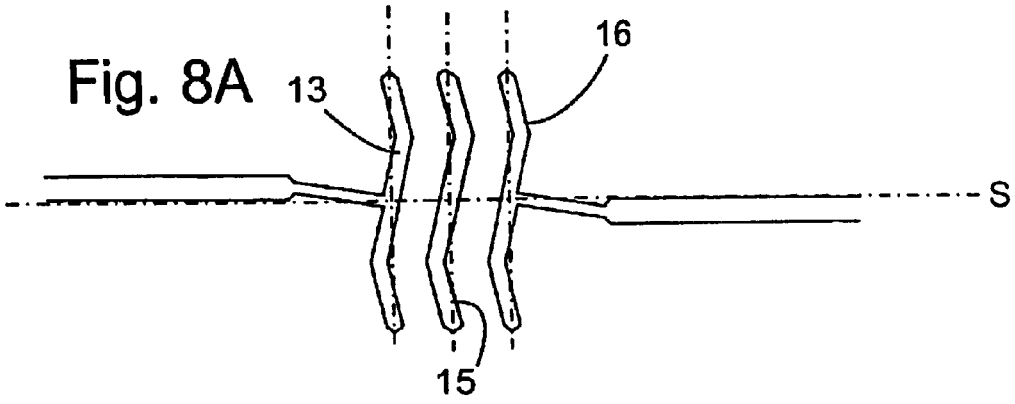
FIGS. 8A, 8B, 8C are top views of sixth to eighth embodiments.

As shown in FIG. 8A, the invention is not limited to straight electrodes and resonators. For example, a sine wave or, as shown here, a zigzag shape of the electrode and the resonator is also possible. For the reduction of radiation to be achieved by the present invention, it is decisive that the electrodes and resonators each have a 180° rotation symmetry or, as shown here, inversion symmetry.

Figure 8B:
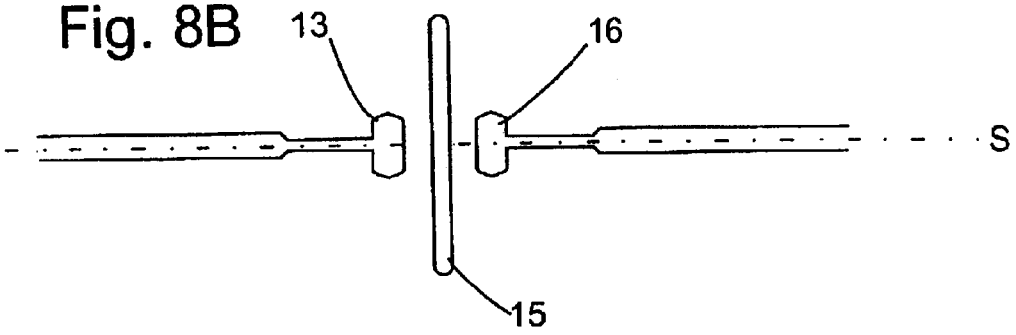

FIG. 8B shows another modification of FIG. 2, in which the electrodes 13, 16 are compact conductor segments having a small extension perpendicular to the signal propagation direction, i.e., to the plane of symmetry S. In this embodiment, the filter effect relies on the resonance of the unconnected resonator 15 alone, a resonance of electrodes 13, 16 is not excited.

Figure 8C:
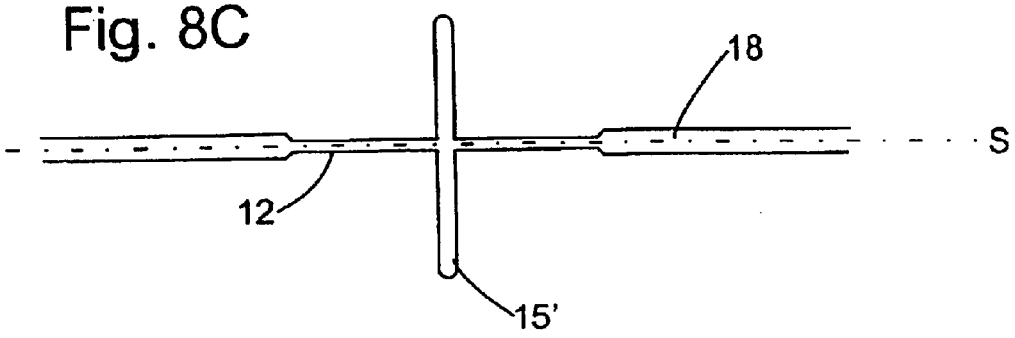

As shown in FIG. 8C, the electrodes 13, 16 can be dispensed of completely, and input conductor 12 and output conductor 18 are directly connected to resonator 15', in which characteristics of the components 13, 15, 16 of the filter of FIG. 2 are combined. However, in addition to the transmission band at the resonance frequency of resonator 15', this filter has a transmission range at low frequencies.

Figure 1:
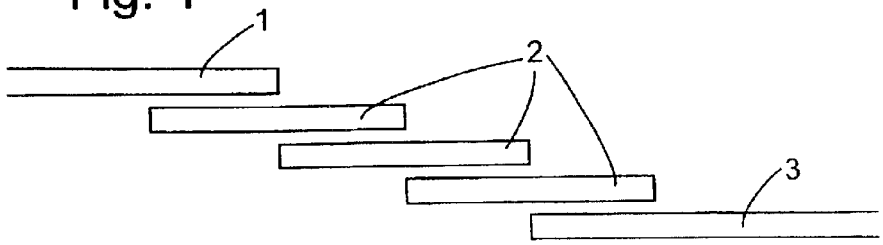
FIG. 1, already discussed, is a schematic representation of a conventional bandpass filter.
Figure 9:
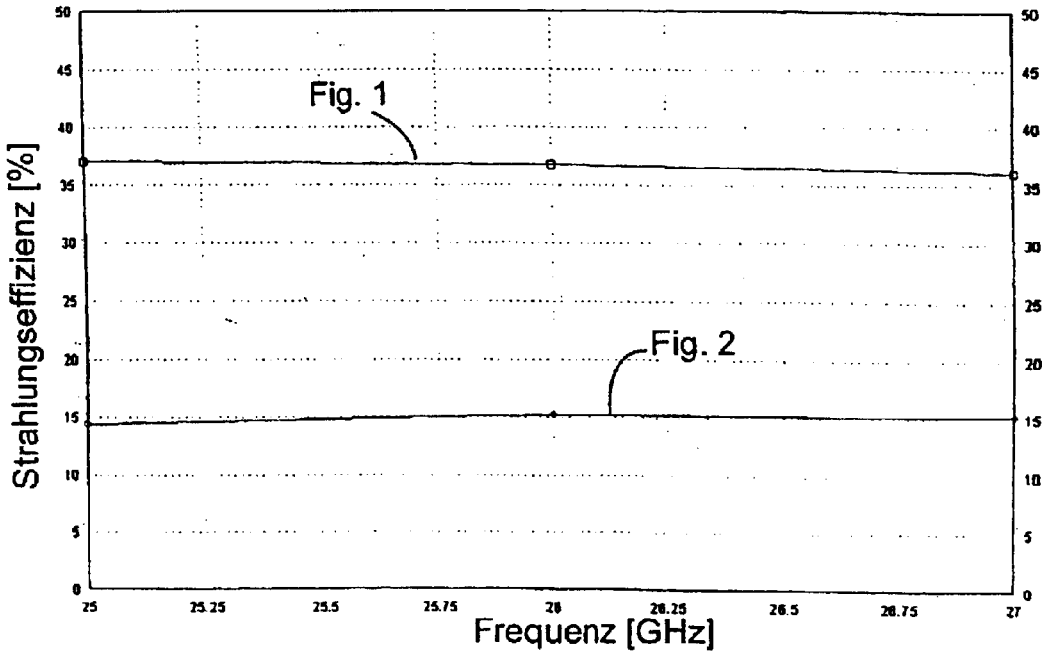
FIG. 9 is a diagram showing radiation efficiencies at various signal frequencies for a conventional filter according to FIG. 1 and the inventive filter according to FIG. 2.

The extent of reduction of radiation that can be achieved with filters having the design shown in FIG. 2, compared to conventional filters according to FIG. 1, is quantitatively shown in FIG. 9. At the ordinate of the diagram of FIG. 9, filter transmission frequencies are indicated, and the abscissa gives corresponding radiation efficiencies in percent. The radiation efficiency is the proportion between the power radiated by sending electrode and the power effectively fed into the resonator. The higher it is, the higher is the proportion of the signal that is uselessly radiated by the filter; it should therefore be as low as possible. This radiation frequency amounts to 15% with the filter of the invention and is thus less than half as high as with the conventional filter whose radiation efficiency ranges between 35 and 40%.

Figure 10A:
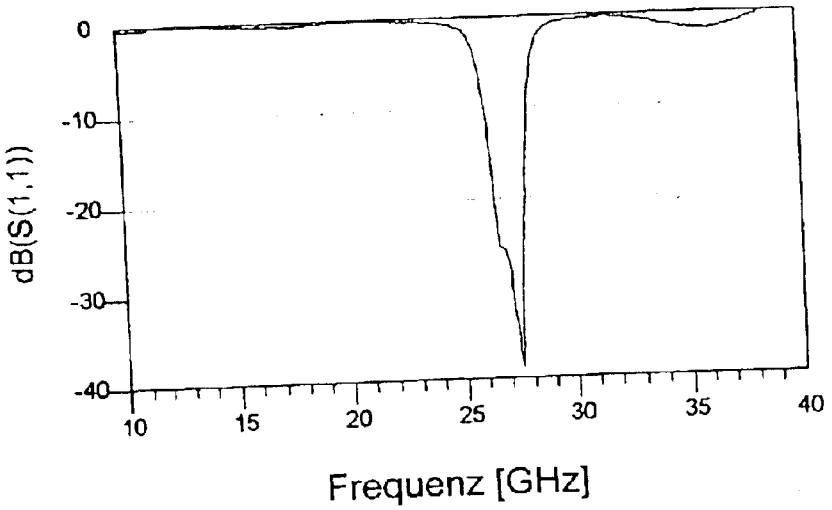
FIGS. 10A and 10B illustrate the reflection characteristic of the filter of FIG. 2.
Figure 10B:
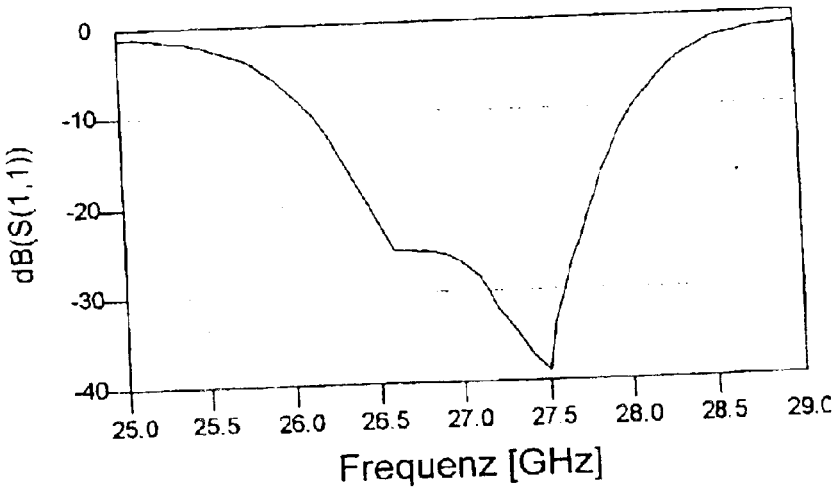
Figure 11A:
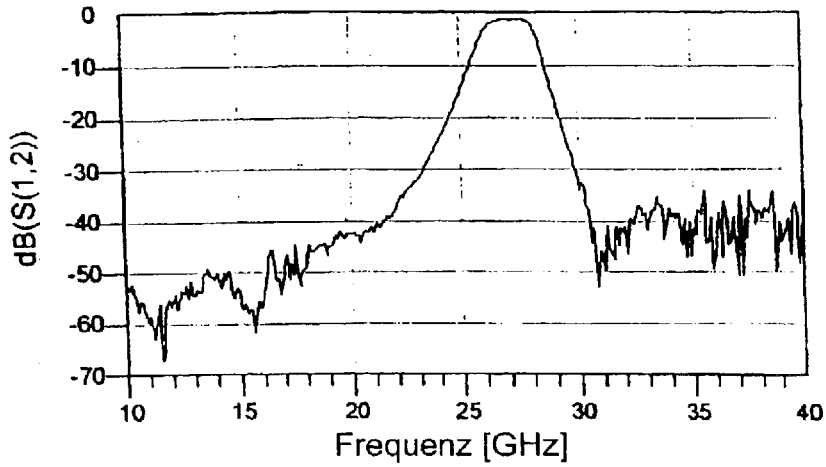
FIGS. 11A, 11B illustrate the transmission characteristic of the filter of FIG. 2.
Figure 11B:
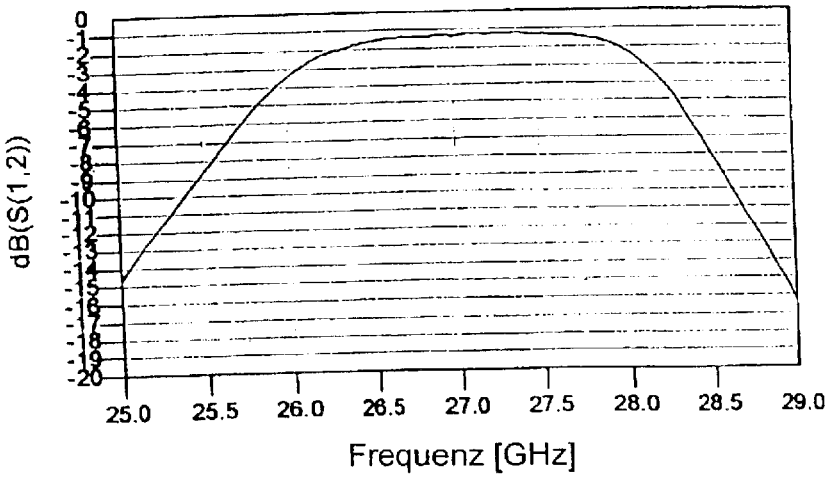

FIGS. 10A, 10B show the reflectivity of a filter according to FIG. 2 having a transmission band at approx. 27.6 to 27.5 GHz for various frequency scales; the transmission characteristic of the same filter is shown in FIGS. 11A, 11B.

Since the radiation of the filter according to the invention is low, a screening is no longer necessary for the operability of the filter, and the filter is rather insensible to the dielectric properties of its environment. This improves the reliability of the filter and reduces its cost.

A further advantage resulting therefrom is the easy tuneability of the center frequency of the filter. There can be considerable scatter in the center frequency of filters manufactured in series production. If these filters are used for an application in which the transmission frequency is predefined with narrow tolerances, this can have the effect that not all filters of the series can be used as they are. Since the filter of the present invention need not be screened, it is easy to carry out a post-processing on filters whose center frequency is outside specification limits.

Figure 12:
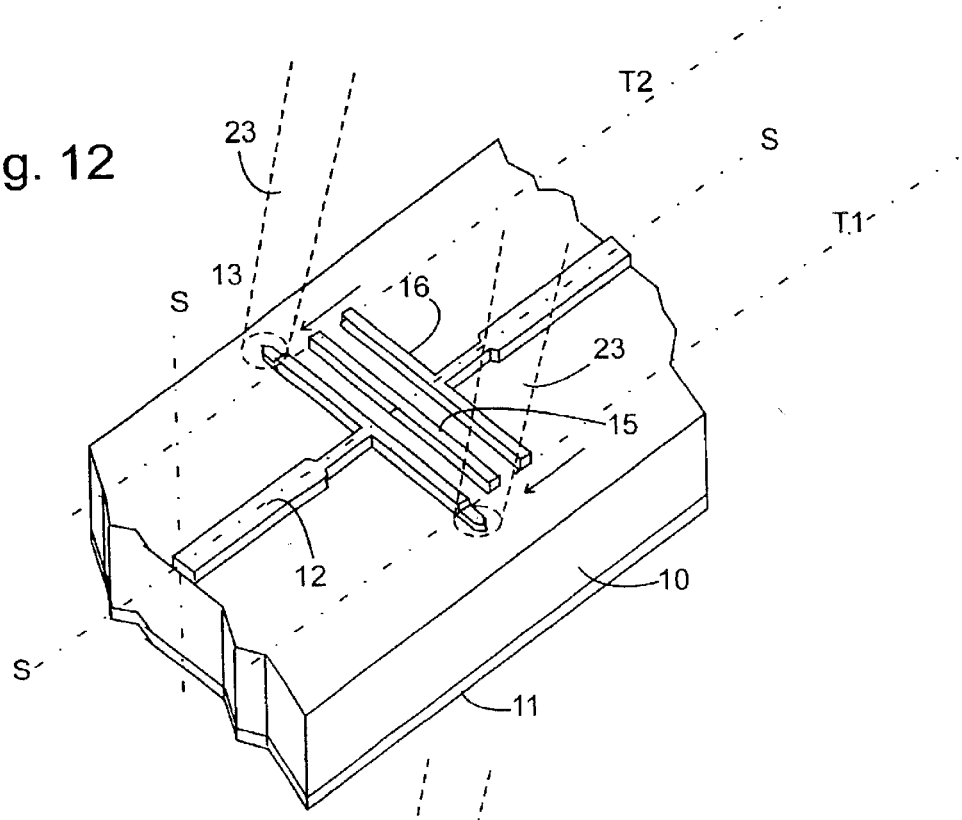
FIGS. 12, 13 are views of a filter during tuning according to first and second embodiments of the method of the invention.

If the transmission frequency of a filter is below a specification, this post-processing is a removal of material at the tips of electrodes 13, 16 and resonators 15. FIG. 12 shows such a post-processing by ablation using a laser beam 23 which is guided along tracks T1, T2 located symmetrically with respect to the plane of symmetry S of the filter and thus cuts all electrodes and resonators to the same length.

If the center frequency of a finished filter is above the specification, an ablation of material can be carried out in regions of the electrodes and resonators between the ends thereof and the plane of symmetry S, so that the filter shown in FIG. 7 results.

Figure 13:
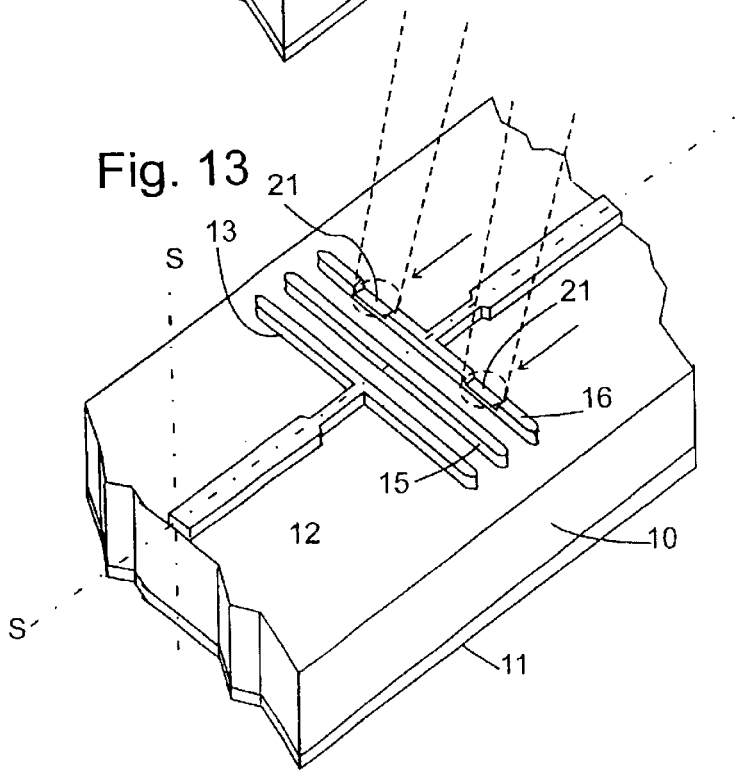

Since the center frequency of the filter according to the present invention depends only little from the dielectric properties of its immediate surroundings, it is also possible to carry out a post-processing as shown in FIGS. 12 and 13 on filters that receive a screening afterwards.

I claim:

1. A bandpass filter, comprising:

a) an input section for a radio frequency signal to be filtered;

b) an output section for the filtered signal; and c) at least one resonator coupled to the sections and having a shape with binary rotation symmetry with respect to a signal propagation plane, and operative to be excited into an oscillation having the same symmetry by applying the signal to be filtered to the input section.

2. A bandpass filter, comprising:

a) an input section for a radio frequency signal to be filtered;

b) an output section for the filtered signal; and c) at least one resonator coupled to the sections and having a mirror symmetric shape with respect to a signal propagation direction, and operative to be excited into an oscillation having the same symmetry by applying the signal to be filtered to the input section.

3. The bandpass filter according to claim 2, wherein there are at least two resonators, one of which is directly coupled to the input section, and the other of which is directly coupled to the output section.

4. The bandpass filter according to claim 3, wherein the at least two resonators are symmetric with respect to the same plane of symmetry.

5. The bandpass filter according to claim 2, wherein the input section comprises an input conductor and a sending electrode, and wherein the output section comprises an output conductor and a receiving electrode.

6. The bandpass filter according to claim 5, wherein the input and output conductors extend at right angles with respect to the sending and receiving electrodes, respectively.

7. The bandpass filter according to claim 6, wherein the sending and receiving electrodes are connected to the input and output conductors respectively, for the radio frequency signal at a fixed point of the mirror symmetry operation.

8. The bandpass filter according to claim 7, wherein the electrodes and the at least one resonator have the same extension perpendicular to a plane of symmetry.

9. The bandpass filter according to claim 8, wherein the electrodes and the at least one resonator are congruent.

10. The bandpass filter according to claim 3, wherein each resonator has an elongated shape.

11. The bandpass filter according to claim 10, wherein each resonator has a longitudinal axis which is perpendicular to a plane of symmetry.

12. The bandpass filter according to claim 11, wherein each resonator has a cross-sectional area which is constant along the respective longitudinal axis.

13. The bandpass filter according to one claim 12, wherein each resonator has a constriction in a region between the plane of symmetry and each longitudinal end of the respective resonator.

14. The bandpass filter according to claim 3, wherein each resonator is a microstrip conductor deposited on a substrate.

15. A method of tuning a bandpass filter having at least one resonator coupled to input and output sections of the filter, comprising the steps of:

a) defining a desired transmission frequency band of the filter;

b) detecting an effective transmission band of the filter; and c) removing material from the at least one resonator, if the detected transmission band differs by a preset amount from the desired transmission band.

16. The method according to claim 15, wherein the removing step is performed by removing the material at ends of the at least one resonator if the detected transmission band is at lower frequencies than the desired transmission band.

17. The method according to claim 15, wherein the removing step is performed by removing material in a region between a plane of symmetry and ends of the at least one resonator if the detected transmission band is at higher frequencies than the desired transmission band.

18. The method according to claim 15, wherein the removing step is performed by a laser.

19. A method of using a bandpass filter having at least one resonator coupled to input and output sections of the filter for filtering a signal having a center frequency and a wavelength which corresponds to a resonance of the resonator having the same symmetry as the resonator, the resonator having a shape with binary symmetry with respect to a signal propagation plane, and operative to be excited into an oscillation having the same type of symmetry by applying the signal to be filtered to the input section of the filter.

* * * * *